United States Patent [19]

Snygg

[11] Patent Number: 4,516,735

[45] **Date of Patent: * May 14, 1985**

[54] METHOD AND APPARATUS FOR WINDING WEBS

[75] Inventor: Keijo K. Snygg, Karhula, Finland

[73] Assignee: Lenox Machine Company, Inc., Lenox, Mass.

[ * ] Notice: The portion of the term of this patent subsequent to Mar. 14, 1996 has been disclaimed.

[21] Appl. No.: 773,400

[22] Filed: Mar. 2, 1977

[30] Foreign Application Priority Data

Mar. 12, 1976 [FI] Finland ..... 760642

[51] Int. Cl.[3] ..... B65H 17/12; B65H 19/26

[52] U.S. Cl. ..... 242/56 R; 242/66

[58] Field of Search ..... 242/56 R, 56.6, 66

[56] References Cited

U.S. PATENT DOCUMENTS

| | | | |
|---|---|---|---|
| 3,049,311 | 8/1962 | Birch | 242/56 R |
| 3,341,144 | 9/1967 | Mase | 242/56 R |
| 3,841,578 | 10/1974 | Dorfel | 242/56 R |
| 3,918,654 | 11/1975 | Okubo et al. | 242/56 R |

*Primary Examiner*—John M. Jillions

*Attorney, Agent, or Firm*—Bucknam and Archer

[57] ABSTRACT

A method and an apparatus for winding of webs of paper, board and the like on cores wherein the wound web roll is supported on two parallel supporting drums. A new core is brought into the space formed by the wound web roll and the supporting drums. The web is fastened to the new core by fasteners such as nails or staples and severed while the wound web roll is being supported by the supporting drum adjacent to the supporting drum on the infeed side of the apparatus and the web is running over the periphery of the new core.

10 Claims, 7 Drawing Figures

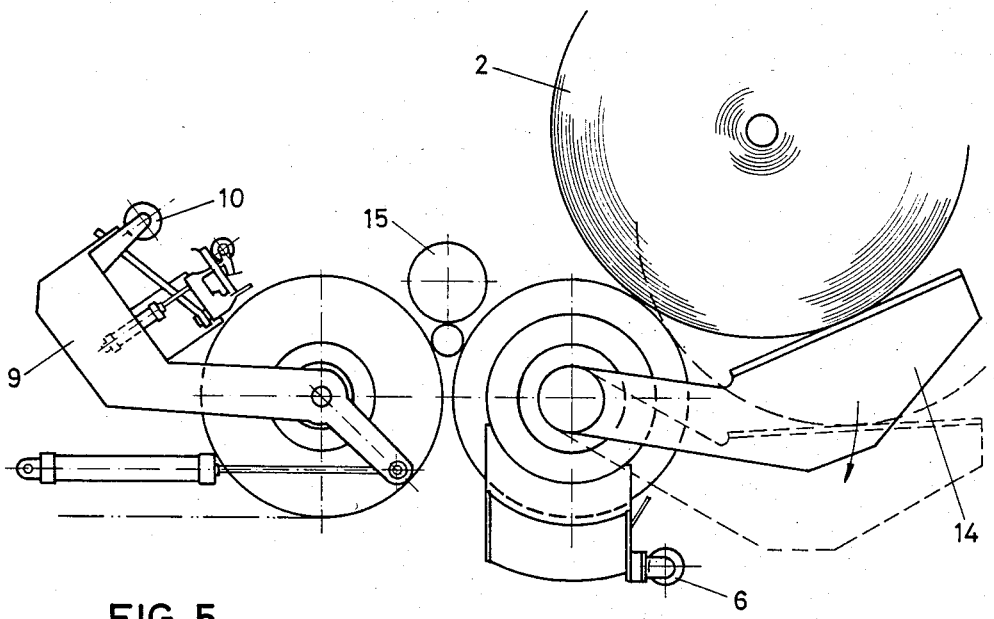
FIG. 5
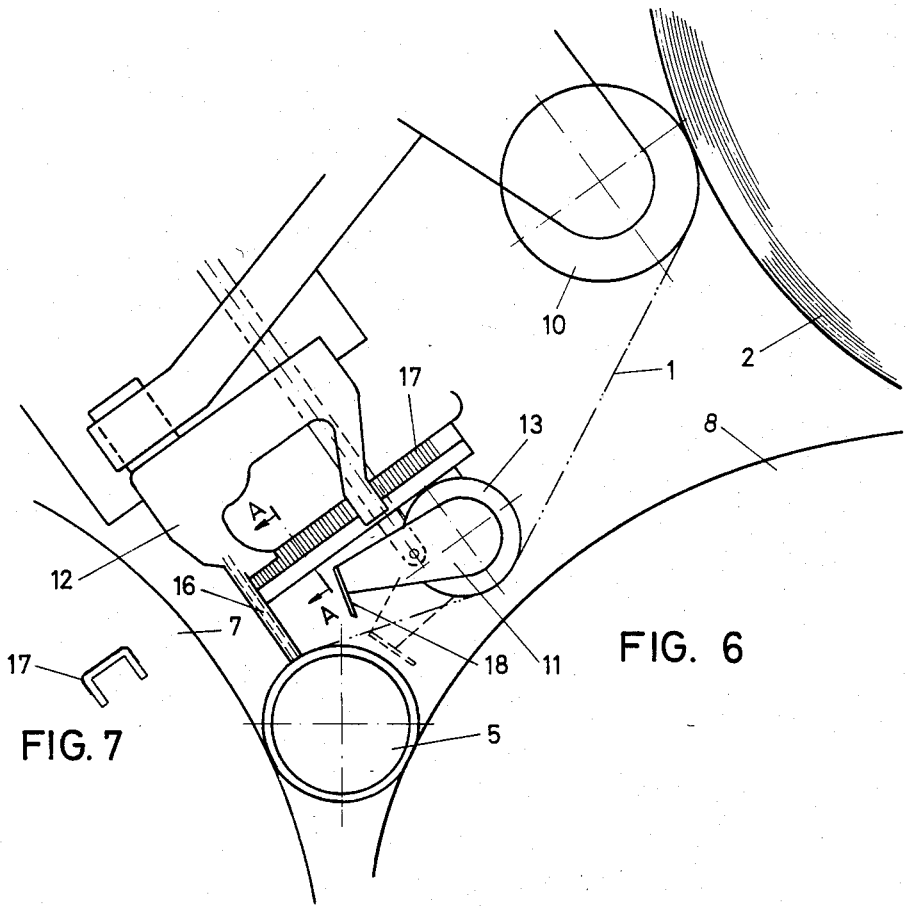
FIG. 6
FIG. 7

METHOD AND APPARATUS FOR WINDING WEBS

BACKGROUND OF THE INVENTION

1. Field of Invention

This invention relates to a method and an apparatus for winding webs of paper, board or the like on a core, wherein the wound web roll is supported on two adjacent drums, which also serve in driving the web roll.

When a roll of the desired size has been formed it is important that the completed roll can be removed, a new core can be brought into the gap between the supporting drums, and the leading end of the web can be brought around the new core without unnecessary loss of time.

2. Description of the Prior Art

The published German Offenlegungsschrift 2 032 724 discloses a method, wherein a new core is pushed into the space formed by the supporting drums and the web roll from one side of the winder, while the web roll is still supported by the supporting drums. This method implies that there is free space corresponding to the width of the web adjacent to the winder, and this restricts the use of the method.

The U.S. Pat. No. 3,841,578 discloses a method and an apparatus for winding of webs, wherein a new core is brought in front of the gap between the supporting drums on that side which is opposite to the completed roll side and pushed to the winding side of the supporting drums through said space while the supporting drums are moved away from each other. This requires that at least one of the supporting drums can be moved towards and away from the other supporting drum. Since the supporting drums have to transmit the torque needed for winding, the drive means are connected to them, which makes the construction very complicated.

The U.S. Pat. No. 2,989,262 discloses a winder, wherein a new core is brought into contact with one of the supporting drums and the rider roll while the completed web roll is supported by the other supporting drum. When the web has been severed, the new leading end of web is brought around the core by means of air nozzles, the core is transferred to the gap between the supporting drums, and the completed roll is ejected to the side of the winder. This arrangement is suitable for winders, where the web is fed to the web roll from below.

When the winding of a new web roll starts, the leading end of the web must first be attached to the core. This is usually done by glueing whereby glue is spread on the core or on that side of the web which is facing the core. The end of the web is brought around the core by hand or by means of belts, air nozzles or other guiding means. The web can be fed to the winder in different ways, but usually it is fed upwards between the supporting rolls.

OBJECT OF THE INVENTION

It is an object of the invention to provide a method which can be used in winders, where the web is fed to the web roll being wound between the supporting drums, a new core is transferred to the winder, the end of the web is attached to the core and the completed web roll is removed with simple means, without causing unnecessary loss of time.

According to the invention the new core is brought into the triangular space formed by the supporting drums and the web roll and into engagement with the supporting drums preferably in such a way that the web roll is first pushed sideways supported on the supporting drum on the infeed side of the web so that a gap is formed between the web roll and the supporting drum on the opposite side through which gap the core can be brought into its place between the supporting drums, whereafter the web roll is brought back to the position where it rests on both supporting drums. After that, the web roll is pushed in such a way that a gap is formed between the web roll and the supporting drum on the infeed side on the web while it rests on the supporting roll on the opposite side. The web is guided to run over the periphery of the core to the web roll by means of a guide roll. As the web roll is in this position, the web is fastened to the core by fasteners such as staples or nails and is at the same time severed. The completed web roll can start. The winder is stopped only during the fastening and severing period.

BRIEF DESCRIPTION OF THE DRAWINGS

The invention is described in the following with reference to the accompanying drawings, in which FIGS. 1–5 illustrate a preferred embodiment of the invention and its function, FIG. 6 shows a detail of FIG. 4 in enlarged scale and FIG. 7 is a sectional view taken on line A—A of FIG. 6.

DESCRIPTION OF THE INVENTION

Figure 1:
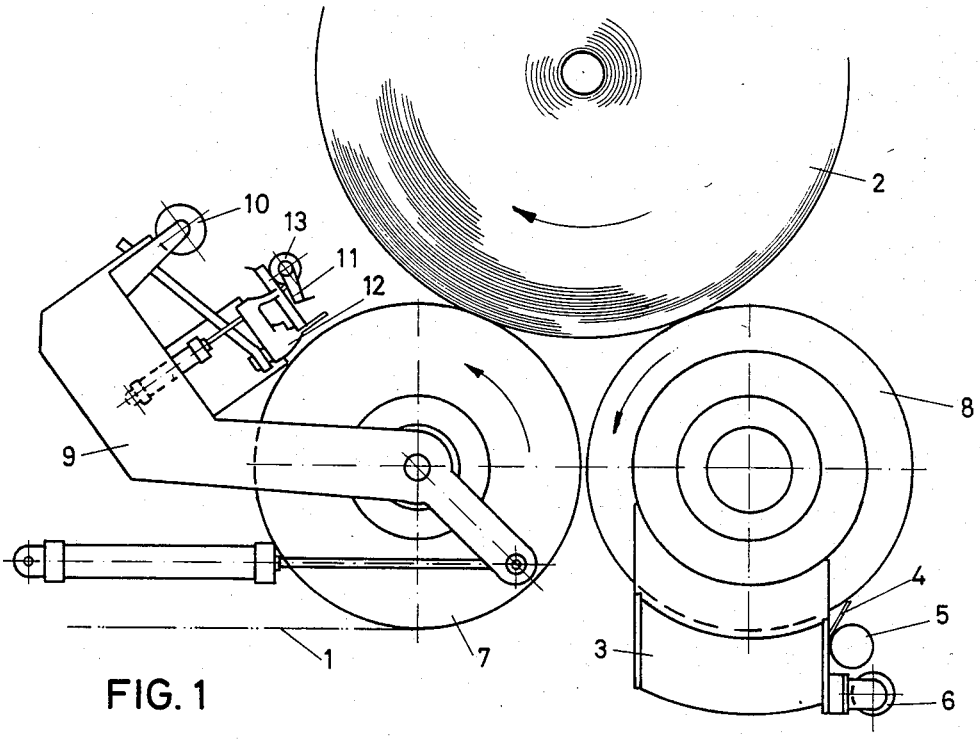

In the drawings, reference numeral 1 indicates a paper web and reference numeral 2, a paper roll (being wound or completed). One or several adjacent cores 5 are deposited in a carrier 4, mounted on arms 3, which are pivoted about the axis of the one of the supporting drums. A pusher roll 6 is also mounted on the arms 3, In the winder there are two parallel supporting drums 7 and 8 on which the paper roll is wound. At least one of the supporting drums is driven. The paper web is fed to the roll from below between the supporting drums in such a way that it runs over the periphery of supporting drum 7. To the left, that is, on the infeed side of the paper web, there are arms 9, mounted pivotally about the axis of the supporting drum 7 and carrying an ejector roll 10. On the arms are also mounted a web cutting means 11, a web fastening means 12 and the guide roll 13. On the right side, i.e. on the roll ejecting side of the winder, there is a receiving and delivery platform 14 (shown only in FIG. 5), pivotally mounted about the axis of the supporting drum 8. During the winding operation the web roll is under a loading force applied by the rider roll 15 (FIG. 5). The loading force of the rider roll is adjustable.

Figure 2:
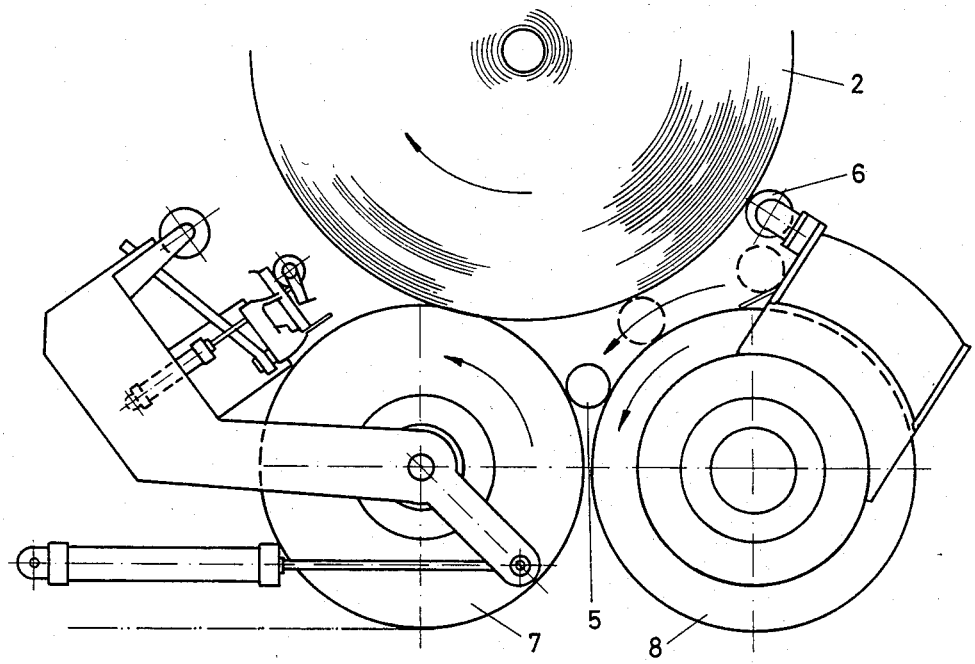
Figure 3:
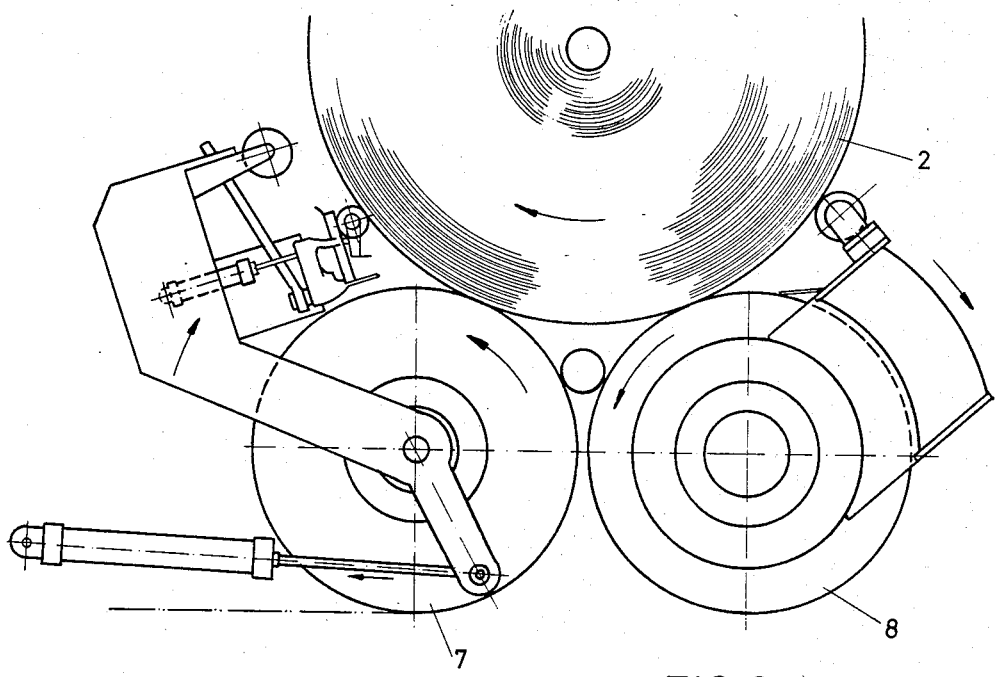
Figure 4:
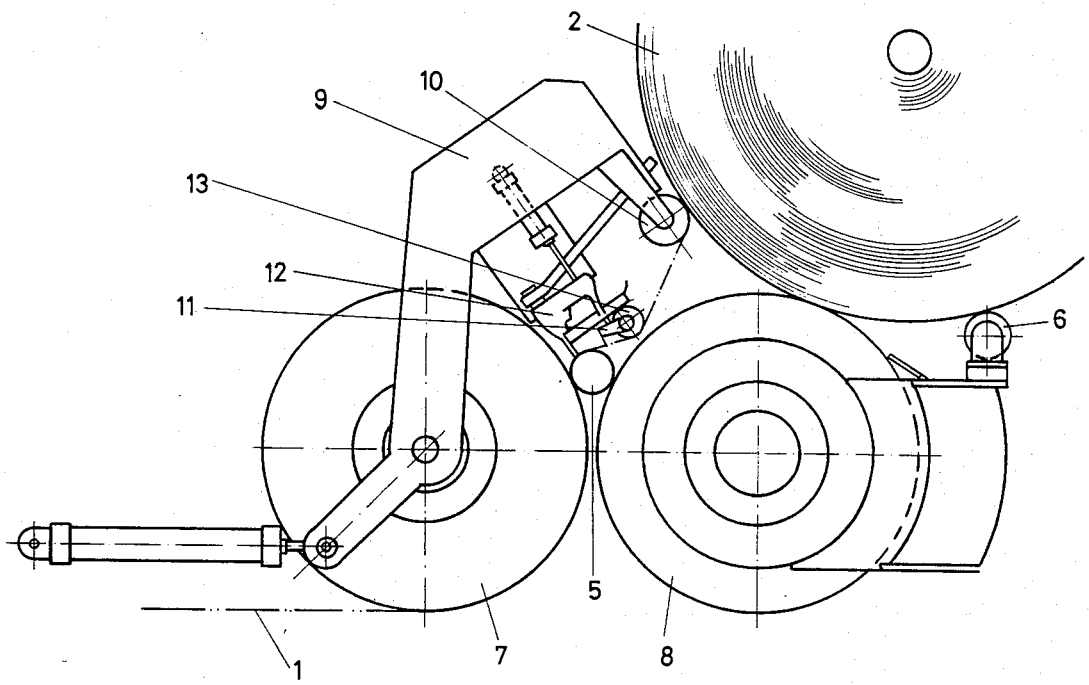

The apparatus functions as follows:

FIG. 1 shows the paper roll 2 in the completed state. The pusher roll 6 is in its initial position. A new core is deposited in the carrier 4 and the arms 3 are in their initial position. In FIG. 2 the pusher roll is moving the paper roll 2, and it has been pushed a sufficient distance to form a gap between the supporting roll 8 and the paper roll, through which the core can be brought into the space between the supporting drums. In FIG. 3 the paper roll has been brought back to its normal position on the supporting drums. In FIG. 4, the arms 9 have been lifted to their upper position and the ejector roll 10 has pushed the paper roll to a position where it is supported by the supporting drum 8, the ejector roll 10 and the pusher roll 6. The paper web runs over the periphery of the core to the paper roll guided by the guide roll 13 and the ejector roll 10. In this position, when the head 16 of the fastening means 12 touches the web 1 at the periphery of the core 5, as shown in FIG. 6, the fastening means, which in the shown embodiment is a stapler tacker, is actuated and the web is fastened to the core by the stapler. At the same time, or immediately thereafter, the web is severed by pushing the knife 18 of the cutting means 11 against the web. In FIG. 5 the receiving and delivery platform 14, has been swung up into its receiving position, from which the paper roll can be lowered by swinging the platform in the direction of the arrow. The ejector roll 10 and the pusher roll 6 have been moved away from the paper roll and the rider roll 15 has been lowered on the new roll to be wound, and a new sequence begins.

The paper web is fastened to the core by fasteners such as staples or nails which are spaced apart about 20 to 30 cm from each other. The staples or the nails can be pushed into the core by mechanically or pneumatically operated means. Within the scope of the invention the new core can also be brought into the gap between the supporting drums by pushing it into said gap from one end of the supporting drums and multiple fastening devices employed.

What is claimed is:

1. In the method of winding a web into a roll upon a core and in which the web roll is supported by two parallel rotatable drums in adjacent spaced-apart relation to each other, and the infed web passes about one of the drums upwardly through the space between said drums and onto the web roll upon said drums, the improvement which comprises the steps of pushing the web roll laterally in one direction into a position in which the web roll contacts one of said drums and does not contact the other drum but defines therewith a first clearance passage; moving through said first clearance passage a new core until same is positioned in the space between said drums; pushing the web roll laterally in the opposite direction into a position in which the web roll contacts said other drum and does not contact said one drum but defines therewith a second clearance passage; positioning the infed web against the new core; moving a fastener applying means through said second clearance passage into engagement with the infed web against the new core; operating said fastener applying means to apply at least one fastener connecting the infed web to the new core; moving a cutter through said second clearance passage into engagement with the infed web to sever same between the connection thereof to the new core and said web roll; and removing said web roll to accommodate winding of the web upon the new core.

2. In an apparatus for winding a web into a roll upon a core and in which the web roll is supported by two parallel rotatable drums in adjacent spaced-apart relation to each other, and the infed web passes about one of the drums upwardly through the space between the drums and onto the web roll upon said drums, the improvement which comprises a first moveable pusher means operable to push the web roll laterally in one direction into a first position in which the web roll contacts one of said drums and does not contact the other drum but defines therewith a first clearance passage; means for moving a new core through said first clearance passage to position said new core in the space between said drums; a second moveable pusher means operable to push the web roll laterally in the opposite direction into a second position in which the web roll contacts said other drum and does not contact said one drum but defines therewith a second clearance passage; means operable to position the infed web against said new core; a fastener applying means extendable through said second clearance passage into engagement with the infed web against the new core to apply at least one fastener connecting the infed web to said new core; a cutter extendable through said second clearance passage into engagement with the infed web to sever same between the connection thereof to the new core and said web roll; and means for removing said web roll to accommodate winding of the web upon the new core.

3. The improvement according to claim 2 wherein said first pusher means is pivotably moveable relative to one of said drums and includes a roller that contacts the web roll to hold said web roll in said first position.

4. The improvement according to claim 2 wherein said second pusher means is pivotably moveable relative to one of said drums and includes a roller that contacts the web roll to hold said web roll in said second position.

5. The improvement according to claim 2 wherein said first pusher means includes a first arm pivotably moveable relative to said other drum and a first roller carried by said first arm, which first roller contacts the web roll to hold said web roll in said first position, and said second pusher means includes a second arm pivotably moveable relative to said one drum and a second roller carried by said second arm, which second roller contacts the web roll to hold said web roll in said second position.

6. The improvement according to claim 5 wherein said second arm carries said fastener applying means.

7. The improvement according to claim 5 wherein said second arm carries said cutter.

8. The improvement according to claim 5 wherein said second arm carries a third roller operable to engage the infed web in the space between said drums and to deflect said infed web against the new core in contact with a circumferential portion thereof.

9. The improvement according to claim 5 including actuator means connected to said second arm and operable to pivotably move same.

10. The improvement according to claim 5 wherein said first arm is pivotable to a lowered position about said other drum to accommodate removal of the web roll over said other drum.

* * * * *